US011191361B2

(12) United States Patent
Eder

(10) Patent No.: US 11,191,361 B2
(45) Date of Patent: Dec. 7, 2021

(54) SEAT ADJUSTMENT MECHANISM

(71) Applicant: IncludeHealth, Inc., Columbus, OH (US)

(72) Inventor: J. Ryan Eder, Columbus, OH (US)

(73) Assignee: IncludeHealth, Inc., Mason, OH (US)

( * ) Notice: Subject to any disclaimer, the term of this patent is extended or adjusted under 35 U.S.C. 154(b) by 0 days.

(21) Appl. No.: 16/797,428

(22) Filed: Feb. 21, 2020

(65) Prior Publication Data

US 2020/0268157 A1 Aug. 27, 2020

Related U.S. Application Data

(60) Provisional application No. 62/809,221, filed on Feb. 22, 2019.

(51) Int. Cl.
*A47C 7/40* (2006.01)
*A47C 3/30* (2006.01)
*A47C 7/00* (2006.01)

(52) U.S. Cl.
CPC ..... *A47C 3/30* (2013.01); *A47C 7/006* (2013.01)

(58) Field of Classification Search
CPC ..... A47C 7/006; A47C 7/402; A47C 3/30
USPC ..... 297/353
See application file for complete search history.

(56) References Cited

U.S. PATENT DOCUMENTS 1,569,708 A * 1/1926 Burns ..... A47H 1/13 248/254
3,223,376 A 12/1965 Ciuffini et al.
4,012,158 A * 3/1977 Harper ..... A47C 7/402 297/353 X
4,036,525 A * 7/1977 Howk ..... A47C 7/402 297/353
4,150,851 A 4/1979 Cienfuegos
4,384,742 A * 5/1983 Wisniewski ..... A47C 7/402 297/353 X
4,639,039 A * 1/1987 Donovan ..... A47C 7/402 297/353 X
4,749,230 A * 6/1988 Tornero ..... A47C 7/402 297/353 X
5,037,158 A * 8/1991 Crawford ..... A47C 7/402 297/353
5,588,766 A * 12/1996 Lai ..... A45B 19/06 248/297.31

(Continued)

*Primary Examiner* — Rodney B White

(74) *Attorney, Agent, or Firm* — Jason H. Foster; Kremblas & Foster

(57) ABSTRACT

A mechanism for adjusting vertical seat position using a single extremity and requires no user weight to lower. The mechanism features a seat with an integrated grip for lifting. A spring-loaded latch obstructs the teeth to prevent seat lowering without rotation of a handle. The latch pivots out from obstructing the teeth when lifted. To lower the user rotates the handle to disengage the latch, causing the seat to lower under its own weight. At the desired height, the user releases the handle to permit the latch to obstruct downward movement. A gas spring may counter-balance to reduce overall effective seat weight, making the seat easier to lift while still allowing the seat to lower under its own weight upon rotating the handle. The mechanism for horizontal adjustment couples to the handle, which displaces a cable that disengages a pin allowing the seat to move horizontally on a track.

18 Claims, 9 Drawing Sheets

(56) References Cited

U.S. PATENT DOCUMENTS 5,649,741 A * 7/1997 Beggs ..... A47C 7/402 297/353
5,685,609 A * 11/1997 Miotto ..... A47C 7/402 297/353
5,695,249 A * 12/1997 Lotfi ..... A47C 7/402 297/353
5,735,577 A * 4/1998 Lin ..... B60N 2/77 297/353 X
5,765,920 A * 6/1998 Lai ..... A47C 1/03 297/411.36
5,951,107 A * 9/1999 Tornero ..... A47C 7/402 297/353
6,082,680 A 7/2000 Woodward et al.
6,264,276 B1 * 7/2001 Chen ..... A47C 7/402 297/353
6,273,384 B1 * 8/2001 Hallmark ..... A47C 7/402 297/353 X
6,276,757 B1 * 8/2001 Brown ..... A47C 7/402 297/353
6,299,253 B1 * 10/2001 Chen ..... A47C 7/402 297/353
6,631,953 B2 * 10/2003 Lai ..... A47C 7/402 297/353
6,709,059 B1 * 3/2004 Cvek ..... A47C 7/402 297/353
7,188,901 B2 * 3/2007 Helmond ..... A47C 7/402 297/353
7,775,593 B2 * 8/2010 Hu ..... A47C 7/402 297/353
8,020,934 B2 * 9/2011 Hu ..... A47C 7/402 297/353
8,128,309 B2 * 3/2012 Tsai ..... A47C 7/402 403/322.1
9,113,716 B2 * 8/2015 Chen ..... B60N 2/3027
10,376,064 B1 * 8/2019 Lai ..... A47C 7/402
10,376,065 B1 * 8/2019 Lai ..... A47C 7/402
2007/0215781 A1 9/2007 Watt et al.
2010/0080650 A1 4/2010 Gorza

* cited by examiner

SEAT ADJUSTMENT MECHANISM

CROSS-REFERENCES TO RELATED APPLICATIONS

This application claims the benefit of U.S. Provisional Application No. 62/809,221 filed Feb. 22, 2019.

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

The invention relates generally to seating structures, and more specifically to a movable seating structure that can be adjusted by one-handed operation from one seating position to another seating position. Something is considered a seating position if a human being can rest his or her weight thereon without substantial vertical movement.

There are many people who would like to exercise but have injuries or other reasons that conventional exercise machines or equipment cannot accommodate them. As an example, many exercise machines have adjustable seating structures for the user to sit upon during use. Seating structures may include an upwardly-facing surface, made of any suitable material, upon which it is comfortable for the human posterior to rest during the exercise. Many such seats can be adjusted to position the surface at the height of the user by raising and lowering the seating structure's support.

The seat adjustment mechanisms of conventional equipment require the user to lift or lower the seat itself, such as with one hand, while simultaneously removing and/or replacing a pin or other structure that holds the seat in place, which may be accomplished using a second hand. In many conventional mechanisms, the user must be resting his or her weight on the seating surface to lower the seat against an upwardly-directed pneumatic ram that raises the seat without the user's weight opposing it. Many users cannot perform these simultaneous actions even though the users can perform the action required by the exercise machine. This results in the person being unable to use an exercise machine merely because he or she cannot actuate the seat adjustment.

Therefore, there is a need for a seating surface of an exercise machine that can be adjusted at least vertically by a single action, and which does not require the user to be sitting on the seat during adjustment.

BRIEF SUMMARY OF THE INVENTION

Disclosed herein is a mechanism that may be drivingly linked to a seat to enable at least vertical seat adjustment when the user engages a single, moveable structure for adjustment in one vertical direction and the same or another structure for movement in the opposite vertical direction. This may be on a seat used with an exercise machine. In all cases, only one such structure needs to be actuated to move the seat either up or down. One such structure may be a hand-engageable handle, such as a lever handle. Another such structure may be a grip used to lift the seat. Other structures are contemplated and will be apparent to a person of ordinary skill from the disclosure herein.

One embodiment is a mechanism for adjusting a seat position. The mechanism allows for height adjustment of the seat using a single human extremity, such as a hand, instead of plural extremities as in the prior art. There is no requirement that any of the user's body weight be resting on the seat in order to adjust the seat height. It is also contemplated that the mechanism includes a structure used to adjust the seat's horizontal proximity to the exercise machine.

The height adjustment mechanism may include a seat with an integrated handle and/or grip that can be used to pull up the seat to adjust its height. Furthermore, there may be a spring-loaded latch that engages an internal rack of teeth. This combination may allow the seat to "ratchet" the latch in and out of the teeth when raised, but not allow it to be lowered until a different action is taken. In order to lower the seat, the user may be required to rotate a handle, which disengages a spring-loaded latch or other obstructing structure and the seat lowers under its own weight. Upon reaching the desired height, the user may simply release the handle and the latch extends into a gap between teeth. The seat may be counter-balanced via a spring to reduce its effective weight so that the seat can readily be raised with one hand. As an example, which is not limiting, the effective weight of the seat may be less than or equal to about 7 lbs, which is an amount that may typically be raised by one hand while still allowing the seat to lower under its own weight by turning the handle.

In one embodiment, the mechanism used for horizontal proximity adjustment of the seat relative to the exercise machine is coupled to the same handle used to adjust height of the seat. When the user rotates the handle, this rotating action may also displace a cable that disengages a secondary pin, thereby allowing the seat to be manually moved horizontally forward and backward on a track or on wheels.

Figure 1:
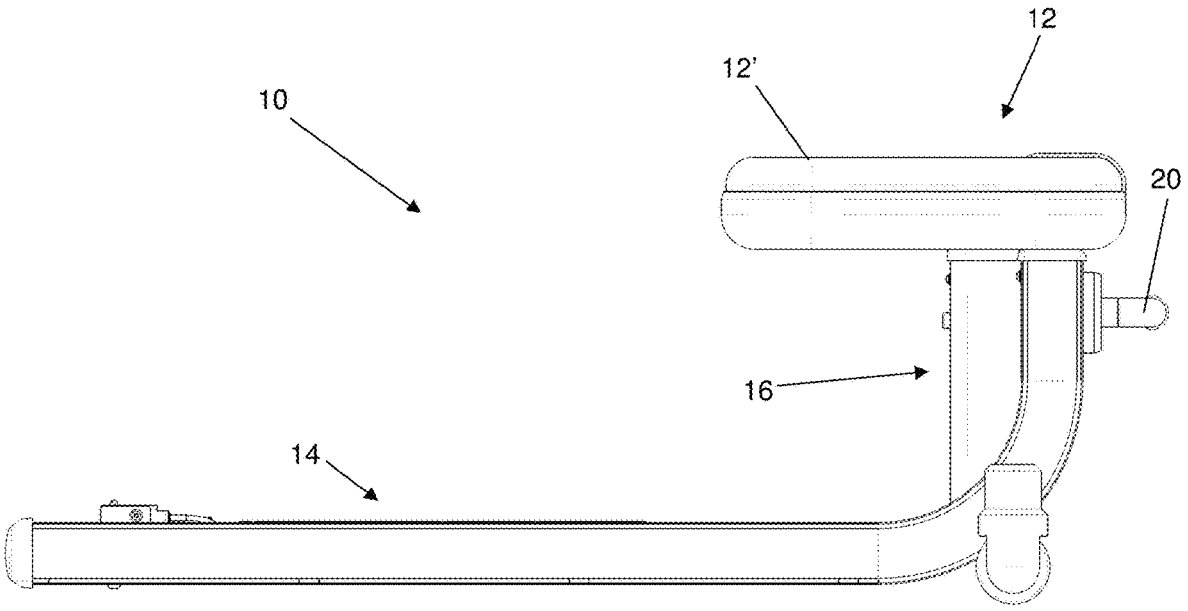
FIG. 1 is a side view illustrating one embodiment of a seating structure and its associated mechanisms.
Figure 2:
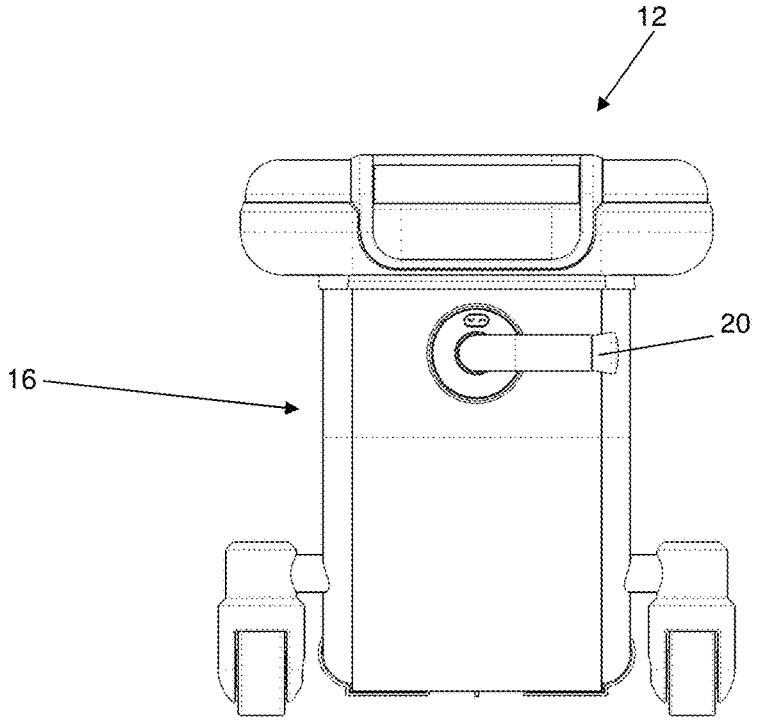
FIG. 2 is an end view illustrating the embodiment of FIG. 1.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

U.S. Provisional Patent Application Ser. No. 62/809,221, which is the above claimed priority application, is incorporated in this application by reference.

In one embodiment, an apparatus 10 has a seat member 12 (also referred to as a "seat") with a seating surface 12' that faces upwardly in the orientation of FIG. 1. The seat 12 may include a rigid, horizontal panel with elastomeric or other padding over which a liquid-impermeable film is stretched. The seating surface 12' may be made of padding with a durable polymer film that a human posterior may rest upon comfortably, and that may resist liquids and be sanitized using conventional cleaning solutions. The seat member 12 is mounted to a base member 14 (also referred to as a "base") that has a lower surface facing downwardly in the orientation of FIG. 1. The lower surface, which may be one or more wheels or skids, rests upon the floor or other surface upon which an associated exercise machine rests when the exercise machine is in an operable orientation.

Figure 3:
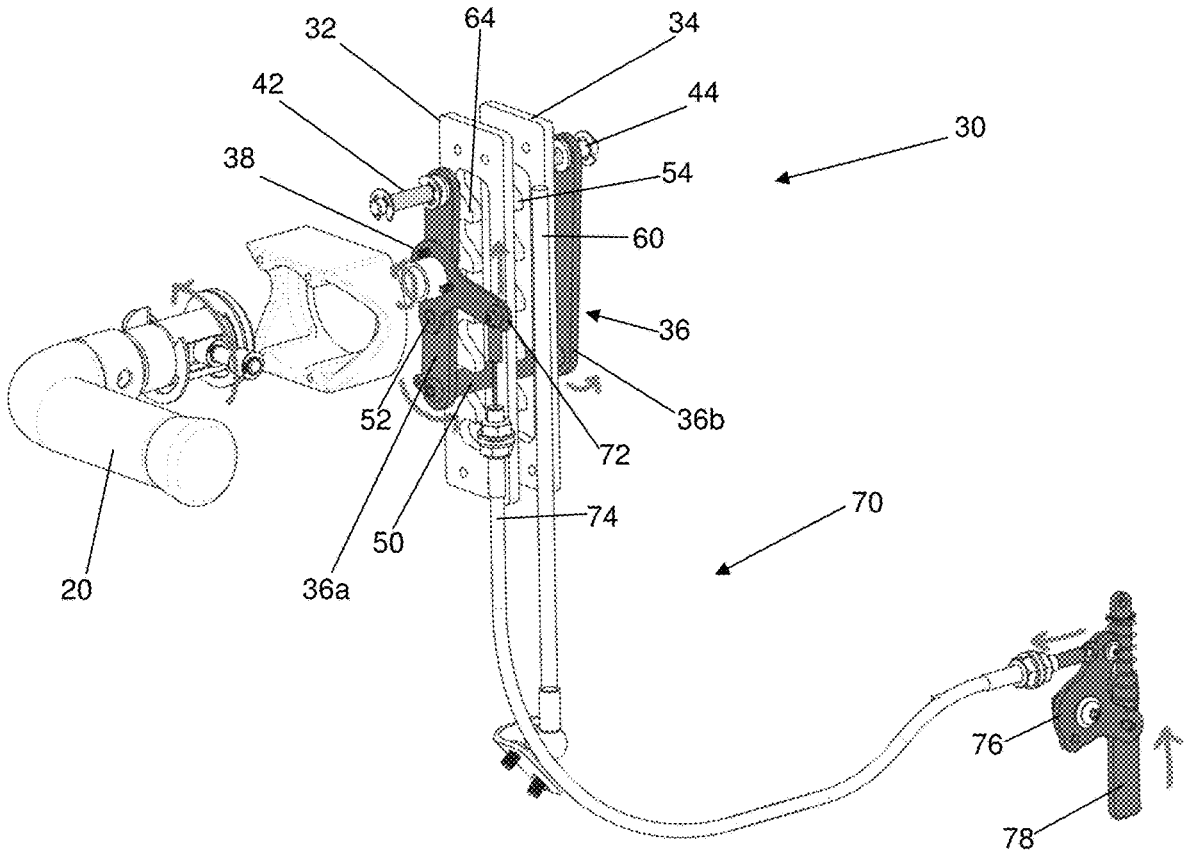
FIG. 3 is a schematic view illustrating an embodiment of the seating structure and associated mechanisms of FIG. 1.
Figure 6:
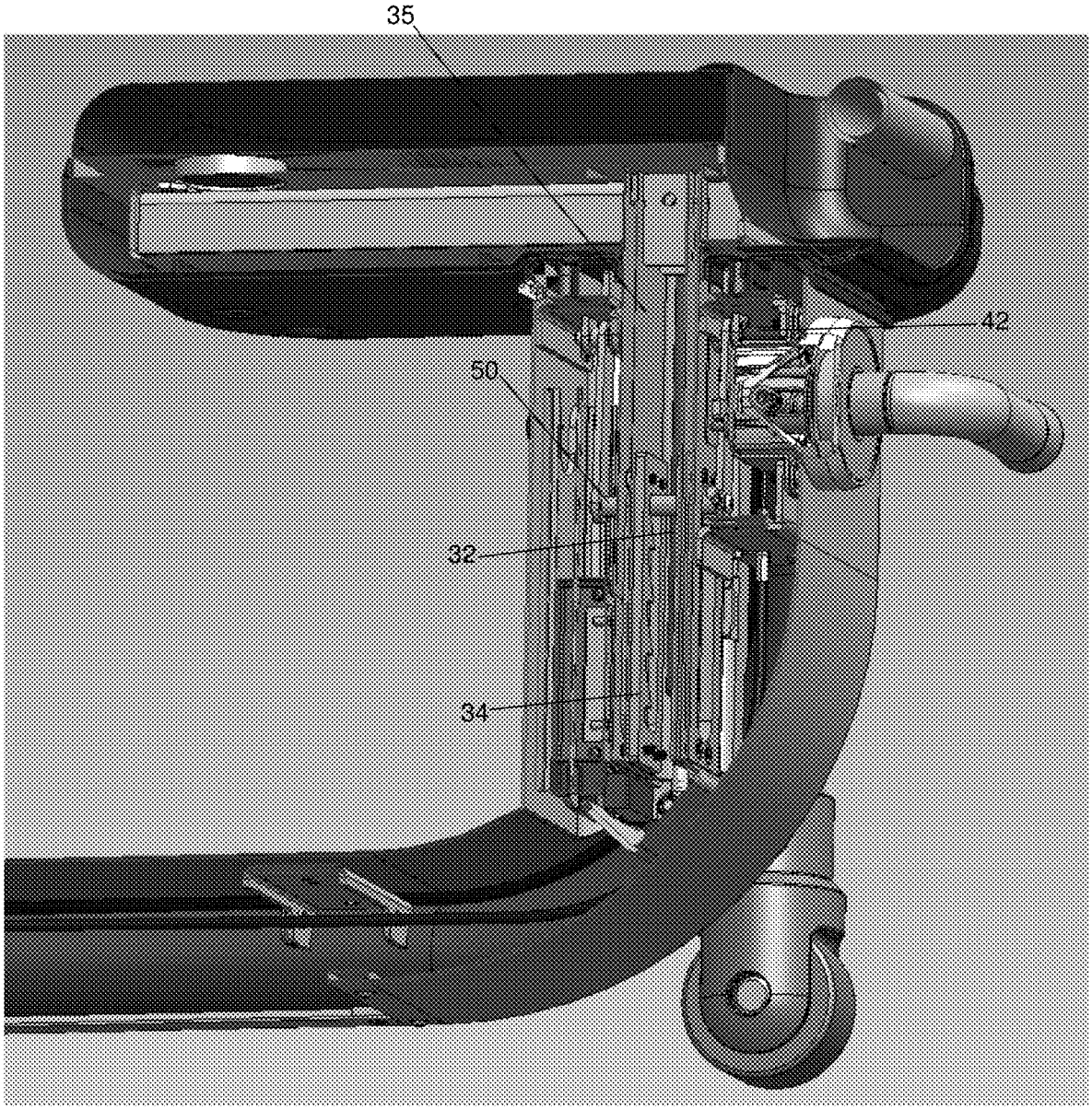
FIG. 6 is a section view in perspective illustrating some of the associated mechanisms of the embodiment of FIG. 1.

A pedestal 16 is disposed beneath the seat 12 and may house a vertical tube member 35 (see FIG. 6) that supports the seat 12 and mounts to the base 14. A lever, which may be the handle 20, protrudes from the pedestal 16. The handle 20 may be L-shaped, as shown in FIGS. 3 and 6, or it may be T-shaped, shaped like a door knob or any other shape that permits manual movement thereof by a human. The handle 20 may be pivotably mounted about an axis that is parallel to a first leg of the L-shaped handle that is closest to the pedestal 16. This axis may be transverse (such as perpendicular) to the second leg of the L-shaped handle that is spaced farthest from the pedestal 16. This configuration permits pivoting of the handle 20 by grasping the handle 20 and rotating about the axis, or by simply pushing one portion of the handle 20, such as the second leg, up or down about the axis of rotation of the first leg without grasping the handle. For example, users who cannot, or do not wish to, grasp may use an elbow, shoulder or foot to push or pull the handle 20 and rotate it about its axis of rotation.

In the embodiment of FIGS. 1-4, a mechanism 30 connects the seat 12 to the base 14 in such a way that the seat 12 may be raised solely by grasping the seat 12 and lifting. Lowering the seat 12 is effected by merely rotating the handle 20, and lowering does not require the user to touch the seat or have a user's weight resting upon the seat. Therefore, raising and lowering can be effected from most angles using one human appendage. The mechanism 30 is one embodiment that makes this possible, and includes a pair of plates 32 and 34 drivingly linked at their top ends to the seat 12. "Drivingly linked" is a term that refers herein to the plates 32 and 34 (or any other structure when this term is used herein) having a connection, which may be through other structures, that permits forces to be applied therethrough. Thus, the plates 32 and 34 may be directly fastened to the seat 12. Alternatively, the plates 32 and 34 may be screwed or otherwise fastened to a tube member 35 or other structure that is directly fastened to the seat 12. Alternatively, the plates 32 and 34 may be contained solely within the pedestal 16 with other extension members extending upwardly to attach to the seat 12. In all of these examples, the plates are drivingly linked to the seat. The plates 32 and 34 may be vertically slidably mounted inside the pedestal 16 and/or another member that extends from the seat 12 to the pedestal 16. As shown in FIG. 6, the plates 32 and 34 may be disposed within the tube member 35, which may be slidably disposed within the pedestal 16 by longitudinally-movable rails.

The latch bar 36 is pivotably mounted at its upper end to the pedestal 16 by the pins 42 and 44. The latch bar 36 has a latch 50 that extends rigidly from one latch bar side member **36*a* to the opposite latch bar side member 36*b* near the end of the latch bar 36 opposite the pins 42 and 44. Thus, when the latch bar 36 pivots about the pins 42 and 44, the latch 50 moves along an arcuate path about the pins 42 and 44. The latch 50 may be a rod with a diameter that permits it to fit in gaps between the teeth 64 and 54 formed on the plates 32 and 34**, respectively.

The latch bar 36 may be biased, such as by a spring (not shown), to rotate toward the deepest regions of the gaps between the teeth 54 and 64, so that the latch 50 may be readily inserted into the gaps. If a torque is applied to the latch bar 36 sufficient to pivot the latch 50 out of the gaps, the biased latch bar 36 will pivot the latch 50 back toward the gaps upon release, or sufficient reduction of, that torque.

Figure 4:
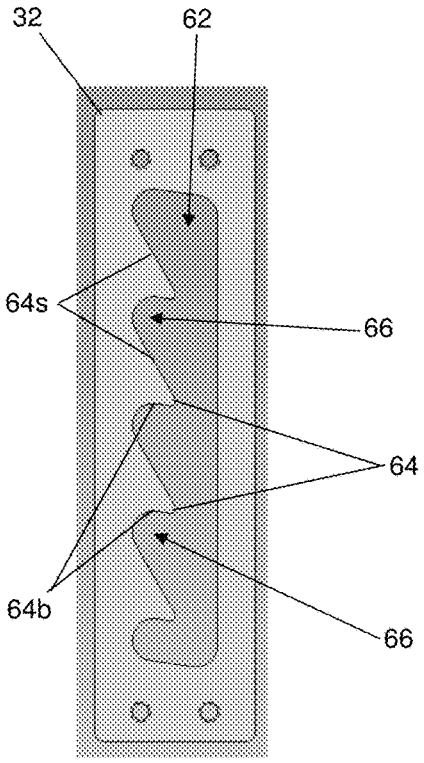
FIG. 4 is a side view illustrating a component of the mechanisms of FIG. 1.
Figure 9:
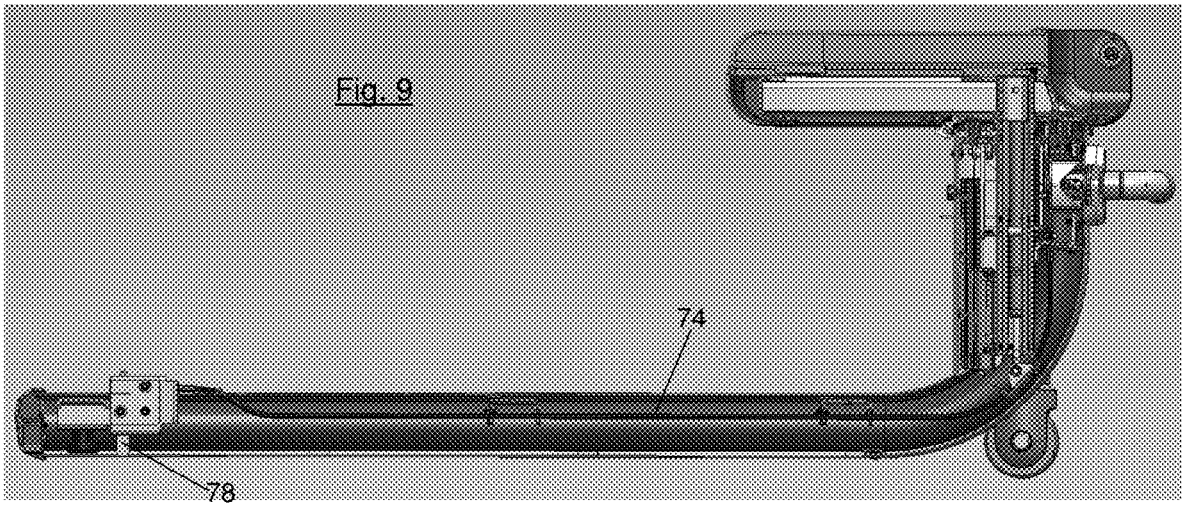
FIG. 9 is a side view in section illustrating some of the associated mechanisms of the embodiment of FIG. 1.

The plates 32 and 34 are preferably identical or at least substantially the same with regard to tooth size and the distance between adjacent teeth. Therefore, only the plate 32 needs to be described and shown in detail. As shown in detail in FIG. 4, the plate 32 has an elongated aperture 62 formed therethrough, and the edges of the plate material that define the aperture 62 define the plurality of teeth 64 and the gaps 66 between the teeth 64. The plate 32 is shown in FIG. 4 with four teeth 64 on one long side of the elongated aperture 62. It is contemplated that fewer or more teeth may be formed in other embodiments. The gaps 66 are formed between each adjacent pair of the teeth 64. Each gap 66 is defined by the edge of the plate material defining the aperture 62 at the deepest region between each of the teeth 64. Thus, every pair of adjacent teeth on each of the plates 32 and 34 has a gap formed therebetween as shown in the plate 32 of FIG. 4. The lowest tooth in FIG. 4 has an effective gap thereunder because there is sufficient room to receive the latch 50, and the highest tooth has an effective gap thereabove because there is sufficient room to receive the latch 50.

Each tooth 64 has a sloped side **64*s* that is at an angle to the longitudinal axis of the elongated aperture 62. That angle may be 45 degrees, and preferably is in a range between about 30 and about 60 degrees, but is less than 90 degrees. Each tooth has an opposite, barb side 64*b* that is at an angle of about 90 degrees to the longitudinal axis of the elongated aperture 62. Each barb side 64*b* may hold the latch 50 from sliding relative to the teeth 64. As is apparent from FIG. 4, each of the barb sides 64*b* may be curved to retain the latch 50, and so the angle relative to the longitudinal axis varies depending upon the point where the measurement is taken. An average angle of about 90 degrees along the length of the barb side 64*b* that is about equal to the diameter of the latch 50 is considered to be within the range contemplated. Furthermore, if the angle and/or shape of the barb side 64***b* cause the latch 50 to be retained in the gaps 66 when a longitudinal force is applied to the plate by resting weight on the seat, the angle and/or shape of the barb side 64*b* is contemplated.

Figure 7:
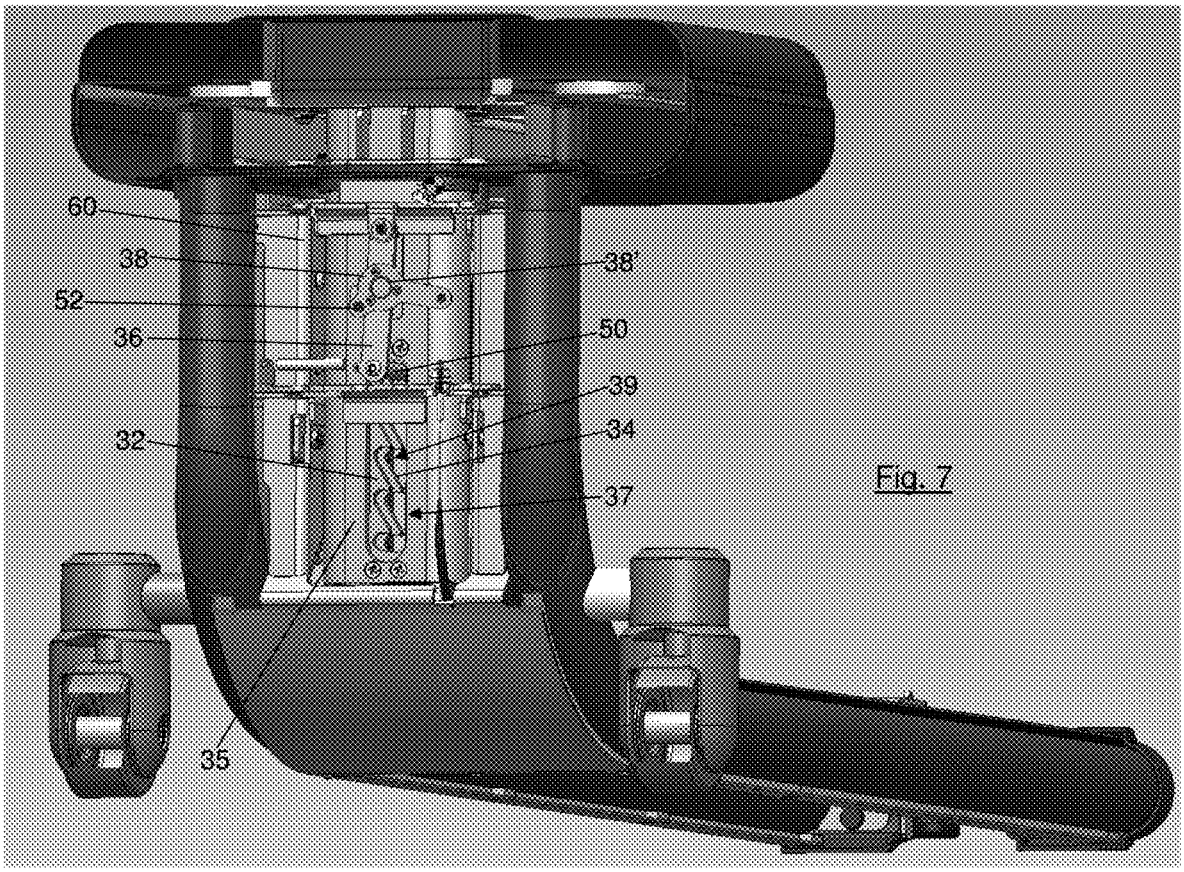
FIG. 7 is a perspective view in section illustrating some of the associated mechanisms of the embodiment of FIG. 1.
Figure 10:
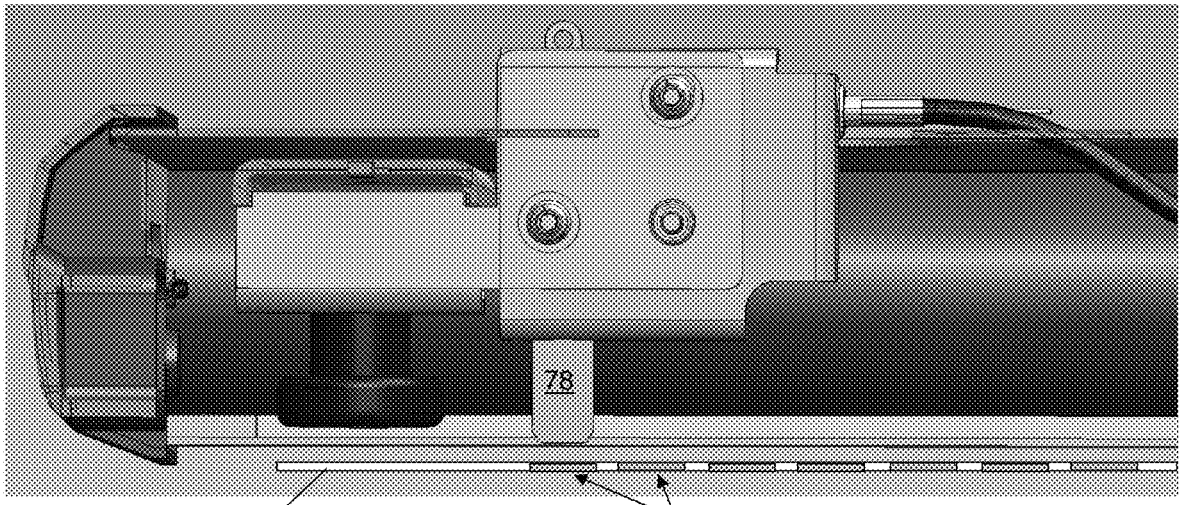
FIG. 10 is a side view in section illustrating some of the components of the associated mechanisms of the embodiment of FIG. 1.
Figure 8:
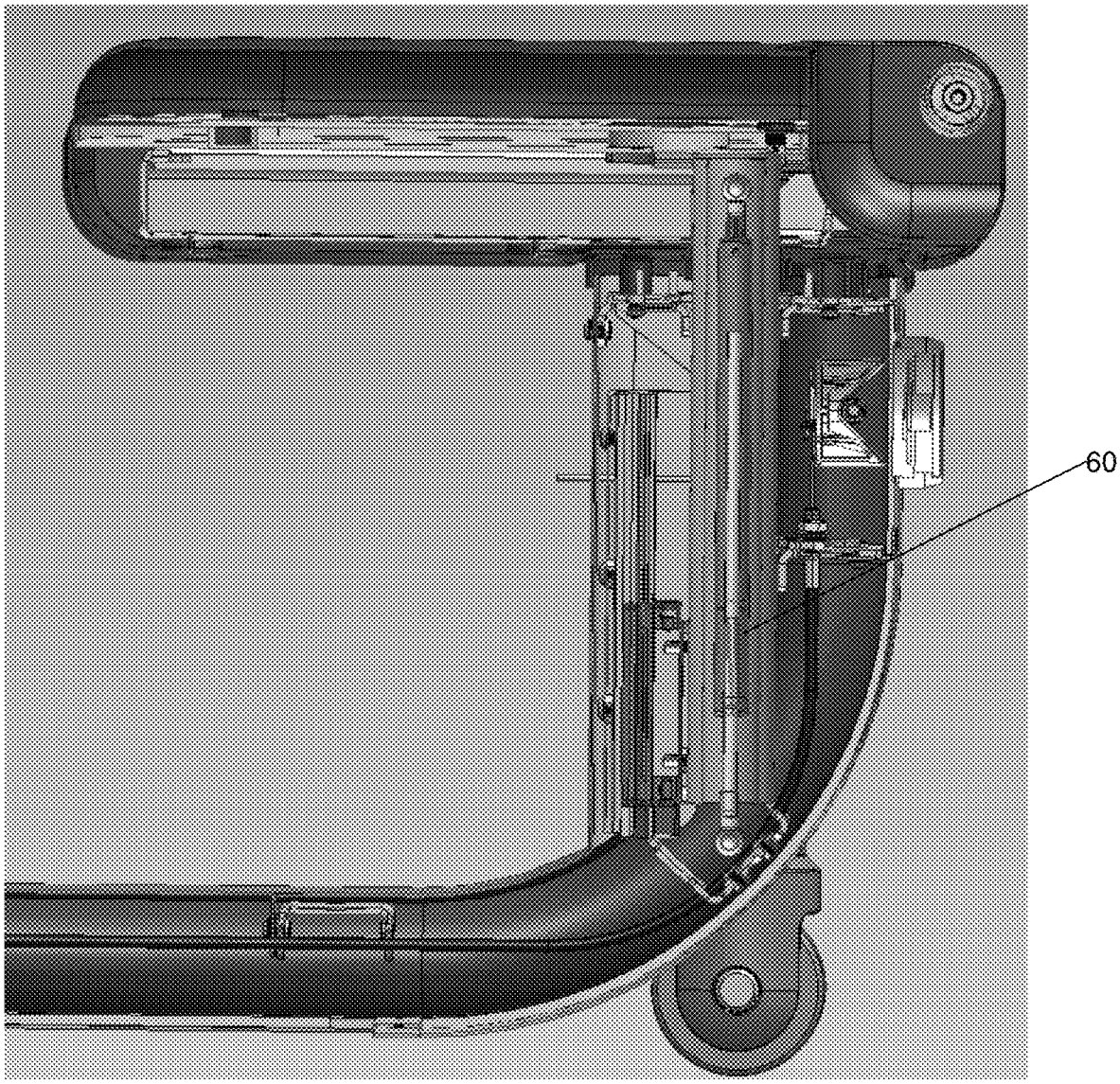
FIG. 8 is a side view in section illustrating some of the associated mechanisms of the embodiment of FIG. 1.

As shown in FIGS. 6 and 7, the plates 32 and 34 are mounted to the sidewalls of the tube member 35, which sidewalls extend upwardly and mount rigidly to the seat. The tube member 35 has slots 37 and 39 that are aligned with the elongated apertures in the plates 32 and 34, thereby permitting the latch 50 to extend through the sidewalls of the tube member 35, as shown in FIGS. 6 and 7. When in an operable configuration, the latch 50 extends through the slots 37 and 39 and through the elongated apertures of the plates 32 and 34.

When the free end of the handle 20 is rotated upwardly (counterclockwise in FIG. 3), the handle link 38, which is rigidly mounted to the handle 20, is rotated similarly about the axis centered on the circle 38' (see FIG. 7). The pin 52 extends from the handle link 38 and may be disposed on one side of the latch bar side member 36*a*, and thus may apply a force transverse to the latch bar side member 36*a*. Rotation of the handle 20 transmits the rotary force applied to the handle 20 through the arcuate movement of the pin 52 to the latch bar side member 36*a*. This transverse force applied by the pin 52 to the latch bar side member 36*a* generates a torque about the pivot pins 42 and 44, which, if sufficient, causes the latch 50 to be displaced out of a gap 66 in which it is held and out of contact with the barb side 64*b* with which it is in contact.

When the latch 50 is positioned in one of the gaps 66 (and one of the corresponding gaps between the teeth of the plate 34), the plates 32 and 34 rest on the latch 50 and the latch 50 serves as an obstructing structure that prevents movement of the plates 32 and 34 relative to the latch bar 36. When the latch 50 is in the gaps and rests against barb sides 64*b* of a pair of teeth 64, the plates 32 and 34 support the seat 12 at least in a vertical direction because the teeth 64 rest on the latch 50 and downward movement of the seat 12 and all connected structures is prevented until the latch 50 is moved. When the latch 50 is moved so it is no longer in a gap 66, the seat 12 may move downwardly relative to the base 14. Thus, when the latch 50 is removed from the gaps 66 and is held outside of the gaps, the weight of the seat 12 permits downward movement of the seat 12 if there is no other obstruction by the mechanism 30.

In one embodiment, a pneumatic spring 60 (FIGS. 3 and 7), or another bias or spring, is mounted at one end to the base 14 and at the opposite end to the seat 12 (or some structure drivingly linked to the base 14 and/or the seat 12), and is preferably interposed between the two. The spring 60 thereby applies an upward force to the seat, or some structure drivingly linked thereto, to make the seat 12 easier to lift by reducing its effective weight, and to slow the descent of the seat 12 when the latch 50 is outside the gaps 66. This upward force is applied even when no user's weight is resting on the seat, and the magnitude thereof may be adjusted to the particular seat's weight. As a result of the spring 60, when the handle 20 is rotated as described above to remove the latch 50 from the gaps in both plates 32 and 34, the seat 12 slowly descends under the resistance of the spring 60 to a lower position. The user watches this movement and then releases the handle 20 at the desired time. Release of the handle 20 causes the latch 50 to rotate, under a bias or another force, back into a pair of gaps that the latch 50 is closest to. The user can judge whether the seat 12 is in the desired position, and can adjust further by rotating the handle 20 again.

Therefore, in order to lower the seat, the user simply rotates the handle 20, which may be by a user grasping it and rotating about the leg of the L-shaped handle that is mounted closest to the pedestal 16 (see FIG. 6). Alternatively, a person who cannot grasp and rotate may simply push up or down on the handle to cause the same rotation, such as by using a foot or other appendage resting upon the handle 20 or lifting upwardly thereupon. When the handle 20 is rotated, the rigidly attached handle link 38 rotates correspondingly. The handle link 38 is disposed adjacent the latch bar 36 with the pin 52 extending from the handle link 38 into contact with the latch bar member 36*a*. Thus, rotation of the handle 20 causes the handle link 38 to pivot the latch bar 36 about the pins 42 and 44. The handle link 38 may rotate about the rotational axis of the handle 20. This rotation of the handle 20 thus disengages the latch 50 from obstructing any teeth, thereby permitting the seat 12 to lower slowly until the handle is released.

Figure 5:
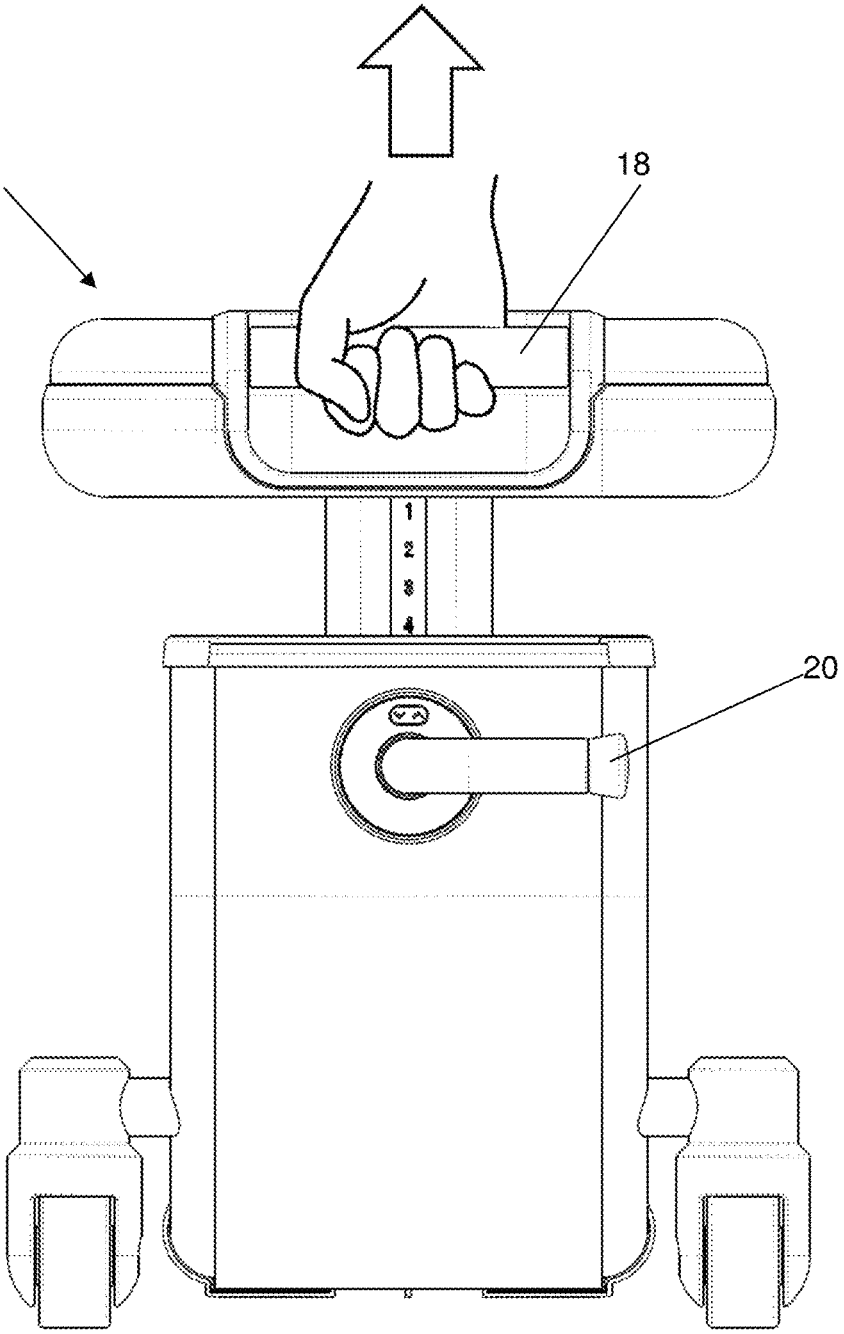
FIG. 5 is an end view illustrating the embodiment of FIG. 1 in use.

A grip 18 may be incorporated into the seat 12, as shown in FIG. 5, in order to make raising the seat convenient. The grip 18 may be a rod or other shape that may be grasped by a person's hand to aid in lifting the seat 12. The seat does not have to be lifted by the grip 18, even if it is present, but may be lifted by applying any upward, vertical force on any part of the seat 12. For example, a user may lift the seat 12 by placing a hand, foot or elbow below the seat 12 and applying an upward force. The handle 20 need not be rotated in order to raise the seat, but the handle 20 may be used to raise the seat, such as by grasping and lifting.

When a sufficient upward force is applied to the seat 12, such as by grasping and then lifting the grip 18, the seat 12 moves upwardly. This is caused as the attached plates 32 and 34 move upwardly relative to the latch bar 36 with the attached tube member 35 and the attached seat 12. Sufficient upward movement by the plates 32 and 34 causes the angled sides 64*s* of the corresponding teeth to slide against and apply a lateral force to the latch 50 as the teeth displace the latch 50, tending to cause rotation of the latch bar 36. This rotation of the latch bar 36 opposes the rotational bias tending to force the latch 50 into the gaps between the teeth. Thus, the lateral force applied by the vertical movement of the sloped sides 64*s* sliding against the latch 50 moves the latch 50 out of the gaps 66 between the teeth 64, and this permits the plates 32 and 34, and the attached seat 12, to move upwardly.

When the latch 50 slides along the angled sides 64*s* of the teeth and reaches the next-adjacent gaps, the latch 50 rotates under the force of the bias back into those next-adjacent gaps. If the upward force applied to the grip 18 is released at this point, the respective teeth of the plates 32 and 34 will be supported by the latch 50 and the seat 12 will stay in this vertical seating position. If the seat 12 is lifted further, the process of the teeth applying a lateral force to the latch 50 is repeated and the latch 50 may be moved to insertion in the gaps 66 between the next lower set of teeth. This process can be repeated as many times as there are gaps. Once the seat is in the desired position, the user simply ceases applying an upward force, and the seat rests in the vertical seating position that is determined by the teeth resting upon the latch 50.

Any lever by which a pivoting movement can be effected is contemplated, and will be recognized by a person having ordinary skill in the art as capable of being substituted for the preferred handle 20. The lever may alternatively be a structure that is translated along its axis in longitudinal movement, for example using a spring-loaded, elongated pin. Such a pin may be installed along the axis of the latch 52 for manual withdrawal from under a tooth along the axis of the pin, and replacement therein. The pin may have the ability to move laterally, such as against a bias, so that upon raising of the seat the pin is displaced laterally as the latch 52 is. Therefore, the lever can effect rotary or longitudinal movement that disengages an obstructing structure as described herein.

Lifting of the seat 12 may be assisted by the pneumatic spring 60 or any other spring or other mechanism, such as a pneumatic ram, that applies an upward force to the seat to reduce its effective weight, which is the force required to raise the seat. The effective weight may be about six to seven pounds, which is a weight that permits a user without the ability to raise a heavy seat to readily lift the seat 12. Furthermore, the process of lowering the seat is also improved by the reduction of the effective weight of the seat 12 caused by the spring 60, due to slowing of the seat movement downward due to the inherent function of a pneumatic spring.

In some embodiments, there are additional structural features that permit the user to adjust the horizontal position of the seat 12 relative to the base 14, or to adjust the horizontal position of the entire seating apparatus 10 relative to the exercise machine (not shown, but which may be any conventional exercise machine). In one embodiment, the apparatus 10 shown herein is mounted to, or used in close association with, an exercise machine such as is shown in U.S. Pat. No. 9,162,102 (Eder), and/or U.S. Pat. No. 7,722,509 (Eder), both of which are incorporated herein by reference. Such mounting or close association may include the insertion of the end of the base 14 that is distal from the seat 12 into or beneath the exercise machine. This may mean that portions of the exercise machine are directly above and/or directly below the distal end of the base 14, or even in direct contact with the distal end of the base 14.

The apparatus 10 may have a horizontal adjustment mechanism 70 that permits the user to release a plunger 78 that retains the seat's horizontal position. This releases the apparatus 10 so the user may move the seat horizontally to a more desirable position. The mechanism 70 may include a finger 72 that extends radially from the handle link 38 as shown in the schematic view of FIG. 3. A conventional cable and a sheath 74 extend from the finger 72 to a plunger link 76 that is rotatably mounted to the base 14 and the plunger 78. Upon counter-clockwise (in the orientation of FIG. 3) rotation of the handle link 38, the cable is displaced upwardly, which rotates the plunger link 76 counter-clockwise in the orientation of FIG. 3. This causes the plunger 78, which extends from a housing that is mounted to the base 14, to move upwardly in the orientation of FIG. 3. Thus, rotation of the handle 20 may cause the plunger 78 to move upwardly, which may withdraw a tip of the plunger 78 from an aperture formed in the portion of the exercise machine into which the distal end of the base is inserted.

An elongated strip 80 may extend from rigid attachment to the exercise machine to beneath the base 14. The strip 80 may be an extension, or upwardly facing wall, of a base of the exercise machine. Alternatively, the strip 80 may be a cantilevered steel or aluminum plate that extends from the exercise machine to close proximity to the plunger 78. A plurality of apertures 82, of similar size to the plunger 78, may be formed in the strip 80 to permit insertion of the plunger when positioned over a respective aperture 82. Thus, by rotation of the handle 20, the plunger 78 may be withdrawn from an aperture 82 in which it is inserted, and the apparatus 10 may be pulled or pushed horizontally to move the apparatus 10 horizontally closer to, or farther from, the exercise machine. Upon movement to a more desired horizontal position, the handle 20 may be released and the plunger 78 will extend into an aperture 82 with which it is aligned. If the plunger 78 is not aligned with an aperture 82 when the handle 20 is released, the apparatus 10 may be pushed or pulled horizontally until the plunger 78 aligns with an aperture 82. Alternatively, the handle 20 may be rotated until the plunger 78 aligns with an aperture 82.

Figure 11:
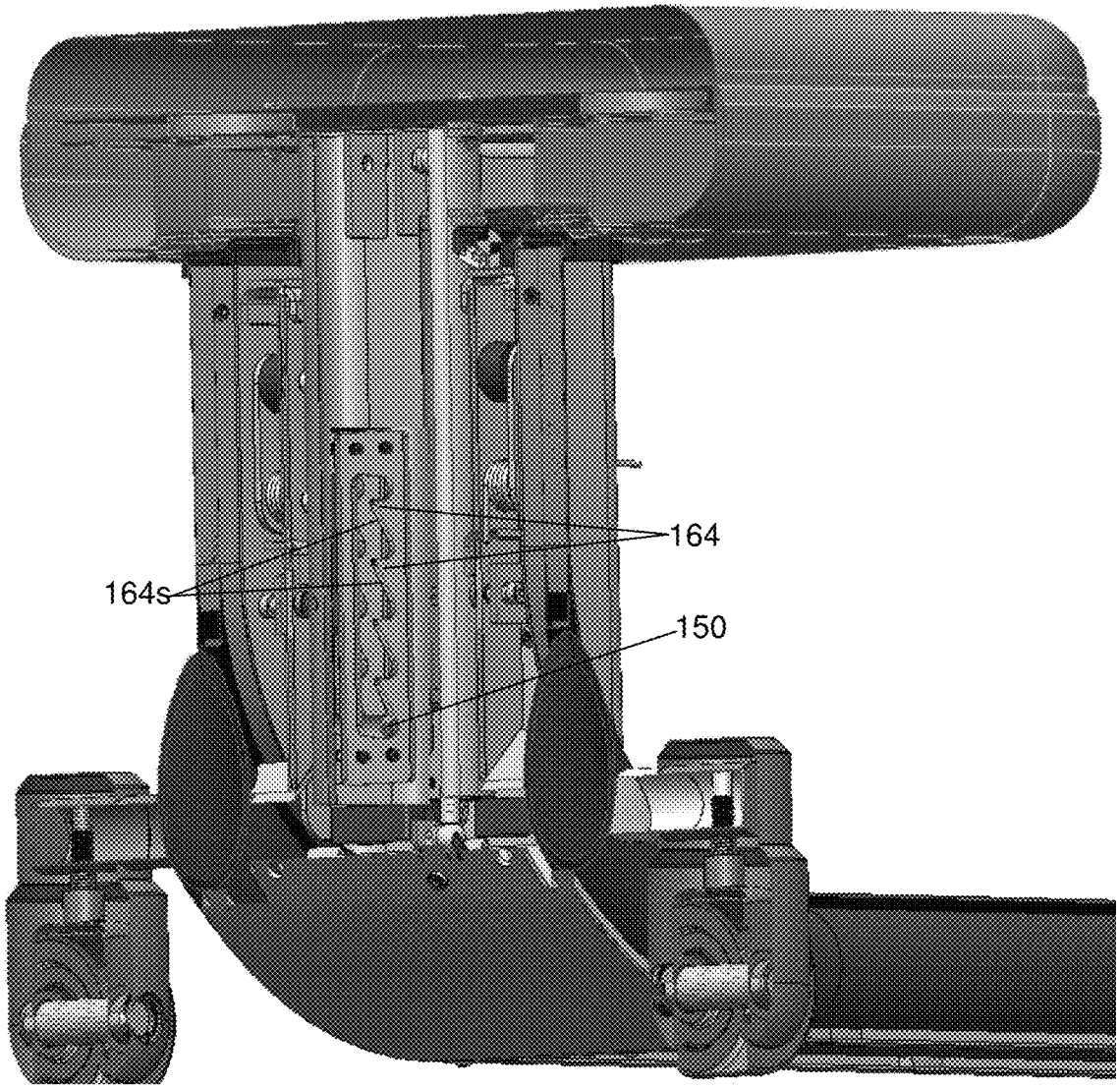
FIG. 11 is a section view in perspective illustrating an alternative embodiment of the invention.

In contemplated alternative embodiments, the teeth 64 that are on the plates 32 and 34 of the embodiment of FIG. 6 may be integral to the tube member 35 rather than formed on plates removably mounted to the tube member 35 or another structure. In other alternative embodiments, the components of the mechanism 30 may have their locations reversed from that shown in FIGS. 6-9. As shown in FIG. 11, the teeth 164 have sloped sides **164*s* that face downwardly in the orientation of FIG. 11. The latch 150 is shown in the gap of the lowest tooth of FIG. 11. The latch bar (not visible), to which the latch 150 is mounted, is drivingly linked to a lever, which may be a handle (not visible) as in the embodiment shown in FIGS. 6-9. It is contemplated that in the FIG. 11 embodiment, the tube member 135 is mounted to the base 114 and the latch bar is mounted to the seat 112. Thus, upon applying an upward force to the seat 112, the latch 150 slides upwardly along the sloped sides 164*s* until it reaches a gap, whereupon the bias causes the latch 150 to insert into the gap. This continues until the upward force is released, whereupon the latch 150** rests upon the upwardly-facing side of the closest tooth, which fully supports the weight of the user.

Figure 12:
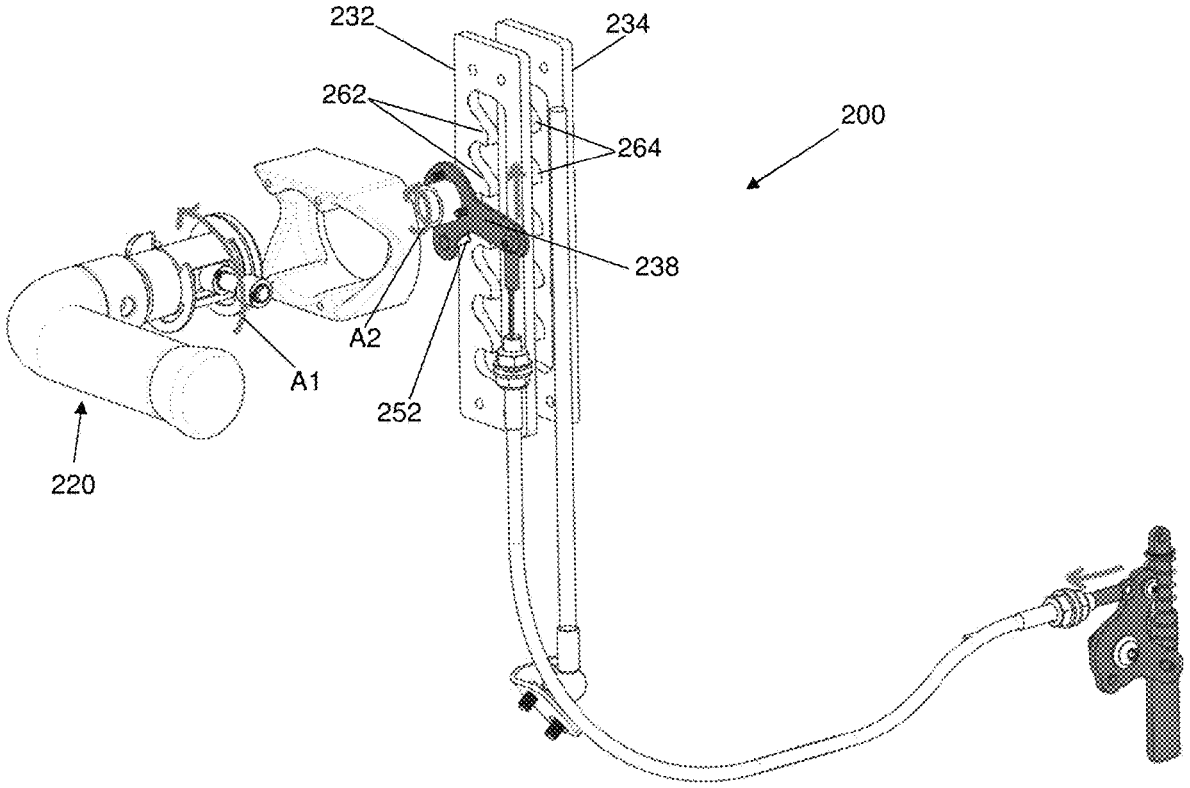
FIG. 12 is a schematic view illustrating an alternative embodiment of the seating structure and associated mechanisms.

In another contemplated embodiment, the pin that is spaced radially from the axis of rotation of the lever, which may be an L-shaped handle, is the obstructing structure that inserts into the gaps. The embodiment of FIG. 12 is structurally very similar to the embodiment shown in FIG. 3, and features that are found in both may not be described for the FIG. 12 embodiment. The plates 232 and 234 are similar to the plates 32 and 34, and are mounted to the seat member, which is not visible in FIG. 12. Each of the plates 232 and 234 has a plurality of teeth 262 and 264, respectively, with one tooth side angled relative to a line that extends along the tips of the respective teeth.

In the embodiment of FIG. 12, there is no latch bar, and the obstructing structure that inserts into the gaps between the teeth 262 and/or 264 is the pin 252 that extends from the handle link 238. The pin 252 is rigidly mounted to the handle link 238 and may be parallel to the axis of rotation of the handle 220, which rotates the handle link 238. The pin is preferably radially spaced from the axis of rotation of the handle 220. When the handle 220 is rotated in the direction of the arrow A1, the handle link 238 rotates in the direction of the arrow A2. When the pin 252 is inserted in a gap between two teeth, the tooth (or teeth) above the pin 252 rests on the pin 252. Thus, the weight of the seat is transferred through the plates 232 and/or 234 and rests upon the pin 252. Rotation of the handle 220 in the direction of the arrow A1 causes the handle link 238 to rotate in the direction of the arrow A2. This movement causes the pin 252 to move along an arcuate path away from the gap into which it is extended and out from beneath the respective tooth or teeth that rest upon the pin 252. In this manner, the seat can be lowered.

Raising the seat is similar to the embodiment of FIG. 3 in which the seat is manually raised. Doing so causes the plates 232 and 234 to move upwardly, which displaces the plates relative to the pin 252. This causes the pin 252 to slide along the angled side of the tooth beneath the tooth that supports the seat on the pin 252. Thus, the upward movement of the plates 232 and 234 causes this sliding of the pin 252 along the angled side, which displaces the pin out of the gap as it rotates the handle link 238 in the direction of the arrow A2. When the pin 252 reaches the tip of the tooth, the bias tending to urge the pin 252 into the gap forces the pin 252 into the gap. With further upward movement, the process repeats until the user ceases upward movement on the seat.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An apparatus for vertically adjusting and retaining a seat member relative to a base member, the apparatus comprising:

(a) a plurality of teeth that are drivingly linked to the seat member, extend along a line and define a plurality of gaps, wherein each of the gaps is formed between adjacent teeth and an upwardly-facing side of each of the teeth is angled relative to the line by an amount less than ninety degrees;

(b) a latch bar with a latch that can insert in, and is biased toward, at least one of the gaps, wherein the latch bar is drivingly linked, and pivotably mounted, to the base member at an axle that is vertically spaced from at least some of the teeth when the apparatus is in an operable position; and (c) a lever with an axis of rotation and a rigidly attached pin that is radially spaced from the axis of rotation and disposed adjacent the latch bar at a location spaced from the latch bar axle, whereupon rotation of the lever in at least one direction about the axis of rotation causes the pin to displace the latch bar about its axle and thereby displace the latch away from the gaps.

2. The apparatus in accordance with claim 1, further comprising a spring drivingly linked to the base member and the seat member that applies a vertical force to the seat member.

3. The apparatus in accordance with claim 2, wherein the spring is a pneumatic spring and the lever is L-shaped with a first leg aligned with the axis of rotation and a second leg being substantially perpendicular to the first leg.

4. The apparatus in accordance with claim 1, wherein the plurality of teeth is formed in plates that are mounted to a tube member that extends from the seat member.

5. The apparatus in accordance with claim 1, wherein when an upwardly-directed force is applied to the seat member sufficient to displace the teeth relative to the latch, the latch slides along the side of one of the teeth that is angled relative to the line by an amount less than ninety degrees, and protrudes out of the gaps.

6. The apparatus in accordance with claim 5, wherein the upwardly-facing side of each of the teeth is angled relative to the line by an amount less than sixty degrees.

7. The apparatus in accordance with claim 1, further comprising a cable extending from the lever to a finger, whereby the finger may be displaced relative to a finger-receiving receptacle upon rotation of the lever in at least one direction, thereby permitting horizontal adjustment of at least one of the seat and base members.

8. An apparatus for vertically adjusting and retaining a seat member relative to a base member, the apparatus comprising:

(a) a plurality of teeth that are drivingly linked to a first one of the base and seat members, extend along a line and define a plurality of gaps, each of the gaps formed between adjacent teeth, wherein at least one side of each of the teeth is angled relative to the line by an amount less than ninety degrees; and (b) a lever including an obstructing structure, whereupon movement of the lever about an axis of rotation causes the withdrawal of the obstructing structure from one of the gaps, wherein the obstructing structure is configured to obstruct vertical movement of the seat member relative to the base member when the obstructing structure is in a gap, and wherein the lever has a first leg aligned with the lever's axis of rotation and a second leg transverse to, and rigidly mounted to, the first leg.

9. The apparatus in accordance with claim 8, wherein the obstructing structure is radially spaced from the axis of rotation, whereupon rotation of the lever about the axis of rotation causes the withdrawal of the obstructing structure from one of the gaps, wherein the obstructing structure is configured to obstruct vertical movement of the seat member relative to the base member when the obstructing structure is in a gap.

10. The apparatus in accordance with claim 9, further comprising a spring drivingly linked to the seat member that applies a vertical force to the seat member.

11. The apparatus in accordance with claim 10, wherein the spring is a pneumatic spring and the lever is L-shaped.

12. The apparatus in accordance with claim 9, wherein the obstructing structure comprises a pin that is biased toward at least one of the gaps.

13. The apparatus in accordance with claim 9, further comprising a latch bar with a latch that is the obstructing structure, wherein the latch bar is biased toward at least one of the gaps, wherein the latch bar is drivingly linked, and pivotably mounted, to a second one of the base and seat members at a latch bar axle that is vertically spaced from at least some of the teeth when the apparatus is in an operable position and wherein a pin is disposed adjacent the latch bar at a location spaced from the latch bar axle and displaces the latch bar about the latch bar axle upon rotation of the lever in at least one direction.

14. The apparatus in accordance with claim 8, wherein a sufficient, upwardly-directed force applied to the seat member displaces the obstructing structure relative to the teeth, thereby causing the obstructing structure to slide along the side of one of the teeth that is angled relative to the line by an amount less than ninety degrees and protrude out of the gaps.

15. The apparatus in accordance with claim 14, wherein the upwardly-facing side of each of the teeth is angled relative to the line by an amount less than sixty degrees.

16. The apparatus in accordance with claim 8, wherein the plurality of teeth is formed in plates that are mounted to a tube member that extends from the seat member.

17. The apparatus in accordance with claim 8, wherein the plurality of teeth is formed in plates that are mounted to a structure that extends from the base member.

18. An apparatus for vertically adjusting and retaining a seat member relative to a base member, the apparatus comprising:

(a) a plurality of teeth that are drivingly linked to a first one of the base and seat members, extend along a line and define a plurality of gaps, each of the gaps formed between adjacent teeth, wherein at least one side of each of the teeth is angled relative to the line by an amount less than ninety degrees; and (b) a latch bar with a latch that is biased toward at least one of the gaps, whereupon movement of the latch bar causes the withdrawal of the latch from one of the gaps, wherein the latch is configured to obstruct vertical movement of the seat member relative to the base member when the latch is in a gap, wherein the latch bar is drivingly linked, and pivotably mounted, to a second one of the base and seat members at a latch bar axle that is vertically spaced from at least some of the teeth when the apparatus is in an operable position and wherein a pin is disposed adjacent the latch bar at a location spaced from the latch bar axle and displaces the latch bar about the latch bar axle upon rotation of a lever in at least one direction.

* * * * *